US005279089A

United States Patent [19]

Gulur

[11] Patent Number: 5,279,089

[45] Date of Patent: Jan. 18, 1994

[54] INSULATED WALL SYSTEM

[76] Inventor: V. Rao Gulur, 11645 SE. 164th St., Renton, Wash. 98055

[21] Appl. No.: 854,090

[22] Filed: Mar. 19, 1992

[51] Int. Cl.[5] ..... E04B 2/60

[52] U.S. Cl. ..... 52/309.11; 52/309.7; 52/309.9; 52/809; 52/284; 52/593; 52/731.1; 52/731.5

[58] Field of Search ..... 52/309.7, 309.11, 309.4, 52/309.5, 309.6, 309.8, 309.9, 804, 805, 806, 807, 808, 809, 731, 309.16, 284, 286, 589, 593, 731.2, 731.5

[56] References Cited

U.S. PATENT DOCUMENTS

| | | | |
|---|---|---|---|
| 1,159,411 | 11/1915 | Olberg | 52/809 |
| 1,578,344 | 3/1926 | Munroe | 52/593 |
| 2,376,653 | 5/1945 | Boyer | 52/309.11 |
| 3,591,993 | 7/1971 | Reeves | 52/806 |
| 4,388,366 | 6/1983 | Rosato et al. | 52/309.6 |
| 4,619,098 | 10/1986 | Taylor | 52/731 |
| 4,641,468 | 2/1987 | Slater | 52/309.7 |
| 4,774,794 | 10/1988 | Grieb | 52/309.7 |
| 4,862,660 | 9/1989 | Raymond | 52/309.11 |

OTHER PUBLICATIONS

Wallframe Building Systems—Alsco Arco Building Products, brochure "Finally, a building system with features that work, for you and your buyer".

Wallframe Building Systems—Alsco Arco Building Products, brochure "The versatile, one-step framing, sheathing, and insulating building system".

Wallframe—brochure, "Pre-Formed Panes are Lightweight and Job-Ready".

Alsco Arco Wallframe Building System—brochure, "Framing, Sheathing, and Insulation in a One-Step Building System that Works".

Case History: Radford, Va. A Total Wallframe Home—Alsco Arco Building Products, brochure "Build with the Confidence of Arco Technology".

Alsco Arco Wallframe Building System, brochure "Finally . . . A Building System as Unlimited as Your Imagination".

NT Enterprises, 1986, "We've Built the Best Energy Value into the Ultimate Building System", brochure.

*Primary Examiner*—Carl D. Friedman
*Assistant Examiner*—Christopher T. Kent
*Attorney, Agent, or Firm*—Delbert J. Barnard

[57] ABSTRACT

An insulated load bearing wall (10, 10') comprising panels of extruded polymer foam (20, 22, 50, 52, 54, 56) into which tubular, load carrying frame members (12, 14, 48) have been incorporated. A tongue is formed at one vertical edge of each panel (10, 10') and a groove is formed at the opposite vertical edge. The tubular frame members (12, 14, 48) are bonded to the extruded polymer foam.

6 Claims, 3 Drawing Sheets

INSULATED WALL SYSTEM

DESCRIPTION

1. Technical Field

This invention relates to insulated walls for buildings. More particularly, it relates to the provision of an insulated wall and roof system which is constructed from panels which each comprise a main body of polymer foam and tubular frame members.

2. Background Art

It is known to construct wall panels for buildings from expanded polystyrene and metal frame members. ALSCO Building Products, a unit of ARCO Chemical Company, which is a division of the Atlantic Richfield Company, markets a wall system of this type under the trademark WALLFRAME TM. A second wall system of this type is marketed by NU-TECH Building Systems, of Cleveland, Ohio, under the trademark CANO-THERMO TM.

A principal object of the present invention is to provide an insulated wall constructed from extruded (rather than expanded) polymer foam and tubular metal frame members, which wall is structurally superior to such known wall constructions and which includes an improved joint construction by which adjacent wall panels are connected to each other.

3. Disclosure of the Invention

A first embodiment of the invention comprises a plurality of tubular load carrying members. Steel angle frame members extend along the upper and lower inside and outside edges of the wall. Extruded polymer foam fills the space between the tubular frame members in both the thickness and width dimensions of the wall.

In preferred form, the wall comprises core sections of the extruded polymer foam Which have a thickness dimension equal to the distance between the tubular frame members in the width dimension of the wall, and inside and outside sheets of the extruded polymer foam. The sheets outwardly bound the core material and extend between the tubular frame members in the width dimension of the wall.

A second embodiment of the invention comprises a plurality of tubular metal load carrying frame members. Metal angle members extend along the upper and lower inside and outside corners of the wall. Extruded polymer foam outwardly bounds the metal load carrying members and extends between the metal load carrying members widthwise of the wall, to form a wall which is essentially all extruded polymer foam and metal frame members.

In preferred form, this wall may comprise core sections of the extruded polymer foam which have a thickness dimension substantially equal to the thickness dimension of the tubular metal frame members, and inside and outside sheets of the extruded polymer foam. The core material extends between the inside and outside tubular metal frame members in the width direction of the wall. The sheets of extruded polymer foam outwardly bound the core sections and the tubular metal frame members.

In each embodiment, the wall is preferably constructed in panels and the extruded polymer foam is shaped to provide a tongue along one vertical edge of the panel and a complementary groove along the other vertical edge of the panel. In an embodiment comprising core sections and side sheets above the extruded polymer foam, a core section may be made to project outwardly beyond the side sheets to form the tongue. At the opposite edge, the side sheets may be formed to extend outwardly beyond the core, to form the groove.

BRIEF DESCRIPTION OF THE DRAWINGS

Like reference numerals are used to designate like parts throughout the several views of the drawing, and.

BEST MODE FOR CARRYING OUT THE INVENTION

Figure 1:
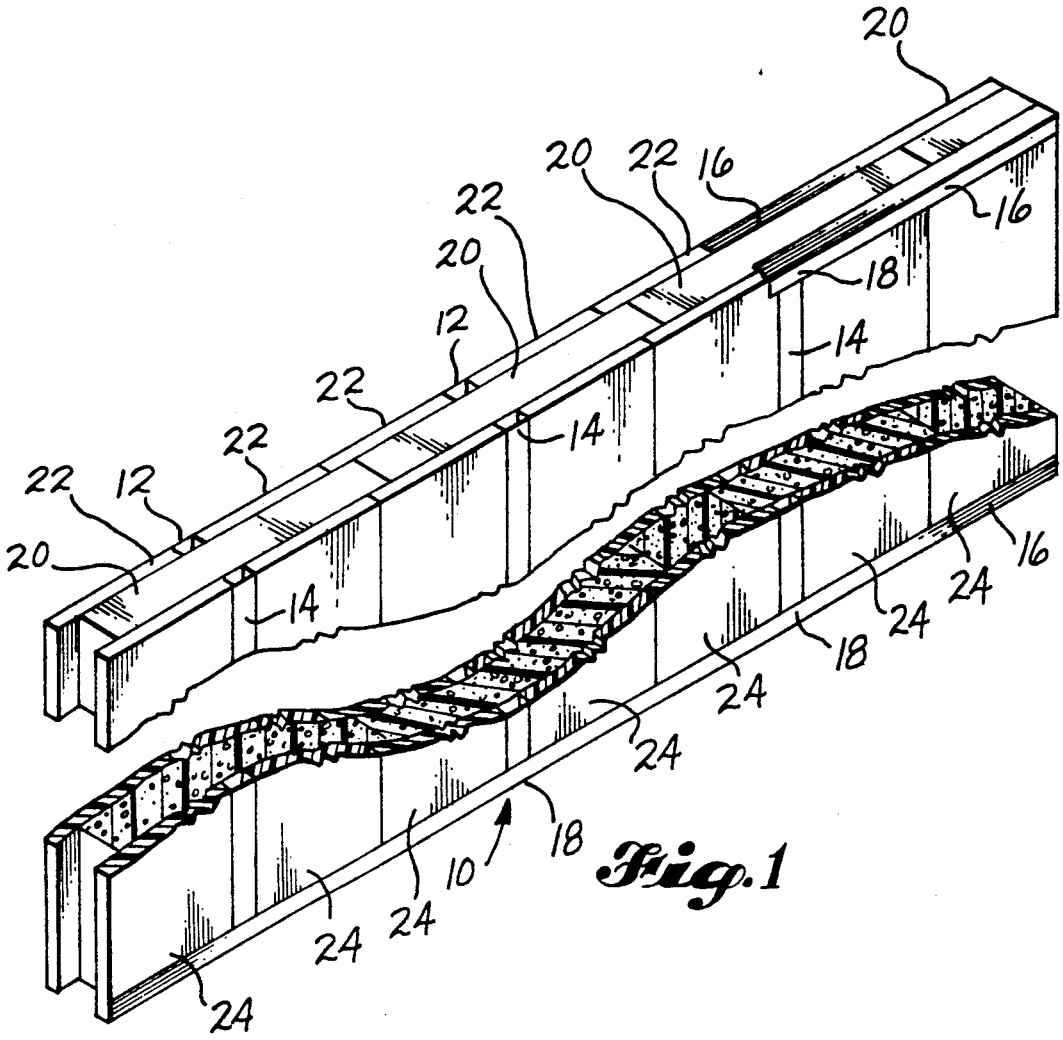
FIG. 1 is a fragmentary pictorial view of an insulated load bearing wall, constructed in accordance with the present invention, with center portions of the wall cut away for the purpose of shortening the height of the wall.

Referring to FIGS. and 2, the wall 10 is shown to comprise a plurality of vertically extending frame members 12, 14. The frame members 12, 14 are lengths of tubular steel or other suitable tubular metal. Frame members 12 are horizontally spaced apart from each other on the outside of the wall 10. In like fashion, the frame members 14 are horizontally spaced apart from each other on the inside of the wall. In preferred form, the outside frame members 12 and the inside frame members 14 are positioned opposite each other in the thickness dimension of the wall 10.

In preferred form, metal angle members 16 extend along the upper and lower edges of the wall 10. The vertical legs of these angle members may be fastened to the tubular frame members 12, 14, such as by the use of screw fasteners 18.

Extruded polymer foam extends between the metal frame members in both the thickness and width directions of the wall. This results in the wall 10 being essentially extruded polymer foam and metal frame members.

In the embodiment illustrated by FIGS. and 2, the extruded polystyrene material comprises a plurality of core sections 20 and a plurality of side sheets 22, 24. The core sections 20 have a thickness substantially equal to the distance between the frame members 12, 14 in the thickness dimension of the wall 10. The side sheets 22, 24 each have a thickness substantially equal to the thickness of the metal frame members 12, 14.

Figure 2:
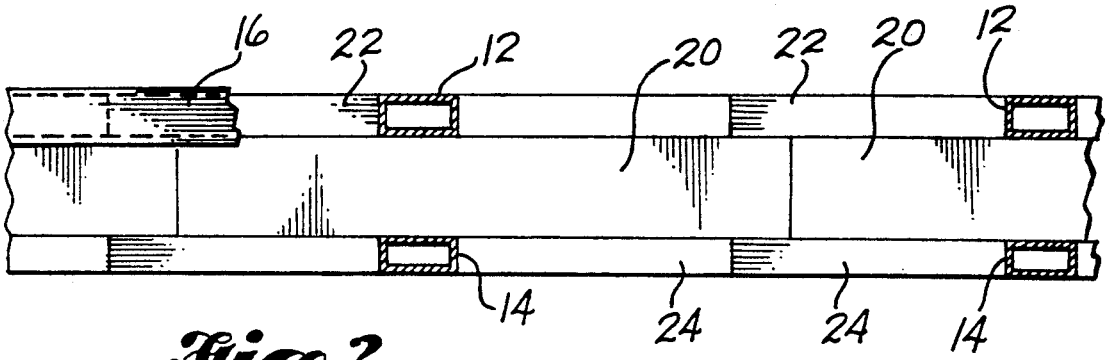
FIG. 2 is a fragmentary top plan view of the wall shown by FIG. 1.

In the embodiment shown by FIGS. 1 and 2, the core sections 20 may be made to extend outwardly beyond the side sheets 22, 24 at one vertical edge of the panel. The side sheets 22, 24 are then formed to extend outwardly beyond the puller section at the opposite vertical edge of the panel. This forms a tongue and groove joint by which adjacent panels may be secured together.

It is also possible to make the extruded polymer foam of each panel a single unitary member, rather than for a core section 20 and side sheets 22, 24 glued together.

The wall may be erected in the following manner. Firstly, the lower metal angle member 16 may be secured in a suitable fashion to a foundation structure. Then, the panels may be assembled together with their lower ends located in the space defined between the upwardly extending legs of the lower angle member 16. Then, the upper angle members 16 may be put in place. As previously stated, screw fasteners 18 or the like may be used for securing the angle member 16 to the frame members 14.

Figure 3:
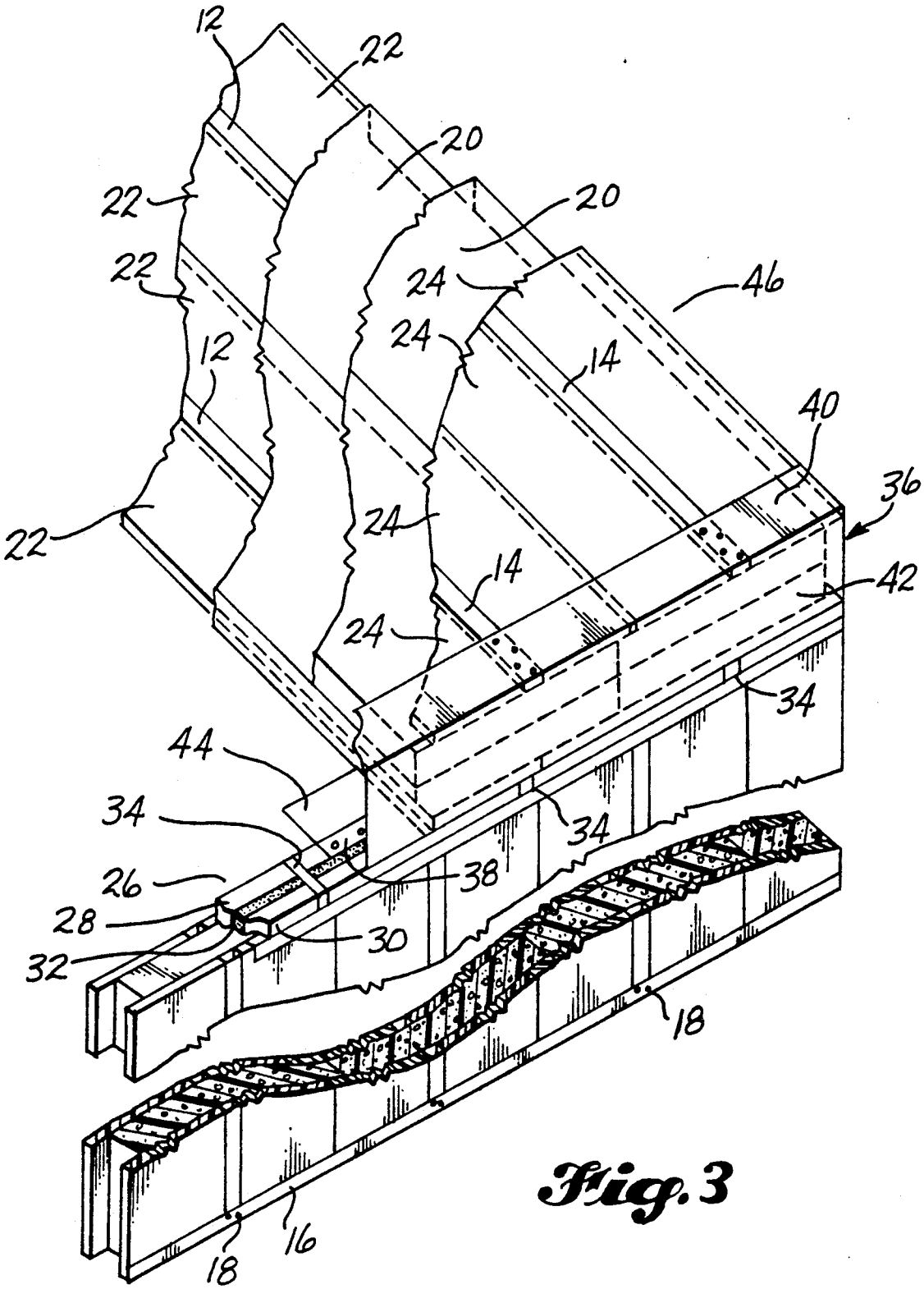
FIG. 3 is a fragmentary pictorial view of a portion of an insulated load bearing wall of the type shown by FIGS. 1 and 2, together with a portion of an insulated roof which along one edge sets down on and is supported by the load bearing wall.

Referring to FIG. 3, this figure shows a wall construction of the type shown by FIG. 2, onto which an insulated plate member 26 has been installed. Plate member 26 comprises a pair of elongated wood members 28, 30 and an elongated extruded polymer foam bar 32 sandwiched between the wood members 28, 30. The wood members are bonded to the extruded polymer foam 32, by a suitable adhesive. Also, reinforcing bands 34 may be placed on the insulated plate member 26 at locations spaced apart along the length of the plate member 26. The bands 34 may be constructed from a structural reinforced plastic or composite materials. By way of example, they may be constructed from any one or a combination of graphite. Kevlar (trademark), and fiberglass for reinforcement, and epoxy as a bonding agent. Phenolic or other resins may be used in place of epoxy as the bonding agent.

Next, a rafter seat 36 may be connected to the plate 26. It is formed from sheet metal and comprises a lower wall 38, an upper wall 40, and a vertical outside wall 42. Tne lower wall 38 may comprise a first section which sets down onto and is secured to the plate 26, and a second section 44 which projects laterally from the first section. The second section 44 and the top member 40 extend at a slope equal to the roof slope. A composite roof 46 is shown. It may be constructed like the walls 10 except with two or more rather than one thickness of the core material.

Figure 4:
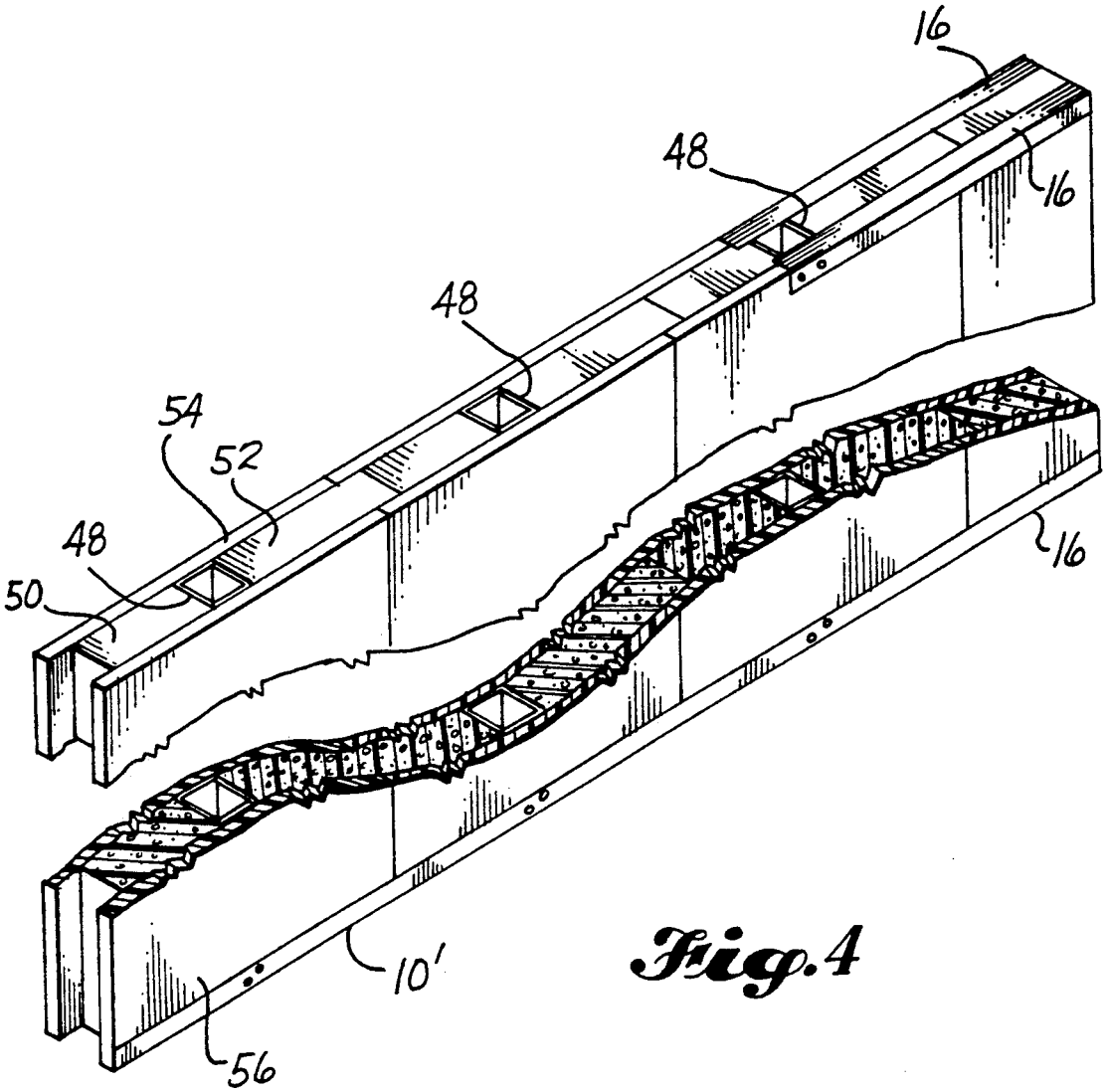
FIG. 4 is a view like FIG. 1, but of a second embodiment of the wall.

Referring now to FIG. 4, the second embodiment of the wall comprises tubular frame members 48, extruded polymer foam core sections 50, 52, and extruded polymer foam side sheets 54, 56. In this embodiment, the tubular frame members 48 are incorporated into the core of the wall 10'. The core members 50, 52 are substantially equal in thickness to the members 48 in the thickness dimension of the wall 10'. The core material 50, 52 is located between the metal frame members 48, throughout the width dimensions of the wall 10'. The metal frame members 48 are shown to be substantially centered in the width dimension of each panel. Core section 50 is shown to be narrower than core section 52. The dimensioning of these core panels 50, 52 is such that core panel 52 projects beyond the vertical edges of the side sheets 54, 56, at one vertical edge of the panel. The side sheets 54, 56 extend outwardly beyond the core section 50 at the opposite vertical edge of the panel. In this manner, tongue and groove joint components are formed.

Wall 10', as in the first embodiment, comprises metal angle members 16 at the upper and lower edges of the wall 10'.

In accordance with the invention, the core sections 50, 52 and the side sheets 54, 56 may constitute a single unitary extrusion.

The arrangement of the frame members (12, 14 in the first embodiment, and frame members 48 in the second embodiment) and the use of extruded polymer foam rather than expanded polymer foam, with the frame members firmly bonded to the foam, results in a wall construction in which the components interact and each is stronger in the combination than it is by itself.

Examples of extruded polymer foams are polystyrene, polyethylene, polyisocynaurite and polyeurothane.

Window and door openings may be bounded by structural metal members and metal sheeting may be used at the corners formed by intersecting walls and by the roof intersecting a wall.

The illustrated embodiments are presented by way of example. The invention is not to be limited by such examples, but rather is defined by the claims.

What is claimed is:

1. An insulated structural wall section having first and second vertical edges and comprising:

a core having an inside and an outside, said core being composed of at least one tubular metal frame member, having four sides and extending the full height of the wall section, and insulation material in the core between said first and second edges, extending vertically the full height of the wall section, said insulation material in the core comprising planks of insulation material;

side regions of insulation material on the inside and the outside of said core, extending vertically the full height of the wall section, said side regions of insulation material comprising inside and outside sheets of insulation material, outwardly bounding the core, on both sides of the wall section;

said planks and sheets of insulation material being extruded from polymer foam and being bonded to each tubular metal frame member;

a tongue formed by said core insulation material at the first vertical edge of the wall section, said tongue being a vertical edge portion of a said plank of insulation material, said tongue extending vertically the full height of the wall section; and a complementary groove formed by said side region insulation material at the second vertical edge of the wall section, said groove being formed by and between edge portions of said inside and outside sheets of insulation material, said groove extending vertically the full height of the wall section.

2. An insulated structural wall section according to claim 1, wherein said core comprises a single tubular metal frame member, a first plank of insulation material between said tubular frame member and said vertical edge, said first plank of insulation material including said edge portion which forms said tongue, and a second plank of insulation material between said metal frame member and said second vertical edge, said second plank having an outwardly directed edge surface that forms a base surface for said groove.

3. An insulated structural wall section according to claim 1, wherein said tubular core comprises a plurality of said tubular metal frame members, said frame members being spaced laterally apart and including a first tubular frame member spaced inwardly from the tongue and a second frame member spaced inwardly from the groove, a first plank of insulation material between said first tubular frame member and said first vertical edge, said first plank including said edge portion which forms said tongue, a second plank of insulation material between said second tubular frame member and the groove, and at least one plank of insulation material between each adjacent said tubular metal frame members.

4. An insulated structural wall, comprising:

a plurality of interconnected structural wall sections, each said section having a width, a thickness, a height, a first vertical edge and a second vertical edge, and each structural wall section comprising a body of insulation material presenting a tongue at the first vertical edge of the wall section, extending the full height of the wall section, and a complementary groove at the second vertical edge of the wall section, extending the full vertical height of the wall section, and at least one vertically extending tubular metal frame member encapsulated within the insulation material, said tubular frame member having four sides, a height equal to the height of said structural wall section, a width less than the width of said structural wall section, and being bounded on all four sides by said insulation material, and on all four sides being bonded to said insulation material;

wherein said structural wall sections are interconnected by tongue and groove joints, each of which is formed by a tongue of a said wall section and a complementary groove of an adjacent said wall section;

metal angle frame members extending along upper and lower inside and outside corners of the structural wall, said metal angle frame members bridging across the tongue and groove joints; and wherein vertical loads on the structural wall are carried by the tubular metal frame members.

5. An insulated structural wall according to claim 4, wherein the insulation material is extruded polymer foam.

6. An insulated structural wall according to claim 4, wherein the core of at least one wall section comprises a plurality of said tubular metal frame members, said frame members being spaced laterally apart and including a first tubular frame member spaced inwardly from the tongue and a second frame member spaced inwardly from the groove, a first plank of insulation material between said first tubular frame member and said first vertical edge, said first plank including said edge portion which forms said tongue, a second plank of insulation material between said second tubular frame member and the groove, and at least one plank of insulation material between adjacent tubular metal frame members.

* * * * *